United States Patent [19]

Wisniewski

[11] 4,440,372

[45] Apr. 3, 1984

[54] BELLOWS MOUNTING ARRANGEMENT FOR SWIVEL CHAIR

[75] Inventor: Joseph M. Wisniewski, Marne, Mich.

[73] Assignee: Haworth, Inc., Holland, Mich.

[21] Appl. No.: 244,840

[22] Filed: Mar. 18, 1981

[51] Int. Cl.[3] ..... F16M 11/00

[52] U.S. Cl. ..... 248/406; 403/134; 403/50; 297/349

[58] Field of Search ..... 248/406.1, 406.5, 188.7; 297/345, 349; D6/30, 31; 403/50, 134

[56] References Cited

U.S. PATENT DOCUMENTS

| | | | |
|---|---|---|---|
| D. 228,536 | 10/1973 | Sottsass | D6/30 |
| D. 239,791 | 5/1976 | Alessandri | D6/30 |
| 3,275,353 | 9/1966 | Turck et al. | 403/134 X |
| 3,623,340 | 11/1971 | Maas | 403/50 X |
| 4,043,564 | 8/1977 | White | 403/50 X |
| 4,220,418 | 9/1980 | Kondo | 403/134 X |

FOREIGN PATENT DOCUMENTS

| | | | |
|---|---|---|---|
| 2420320 | 10/1979 | France | 297/298 |
| 597641 | 1/1948 | United Kingdom | 403/134 |
| 792197 | 3/1958 | United Kingdom | 403/50 |
| 2042102 | 9/1980 | United Kingdom | 403/134 |

OTHER PUBLICATIONS 1-1974, Sottsass, Olivetti Synthesis 45, Scientific Library U.S. Patent Office Design Patent Reference.

*Primary Examiner*—Ramon S. Britts
*Assistant Examiner*—Sarah A. Lechok
*Attorney, Agent, or Firm*—Flynn, Thiel, Boutell & Tanis

[57] ABSTRACT

An extendible and contractible boot is disposed in surrounding relationship to the spindle assembly of a chair. The lower end of the boot is anchored to the pedestal associated with the chair base. The upper end of the boot is supported on the seat assembly by a retainer arrangement which prevents vertical separation between the boot and seat assembly but permits relative rotation therebetween. This retainer arrangement employs a bearing ring, preferably of a split construction, which is snugly and resiliently seated within the upper end of the boot. A retainer plate is secured relative to the spindle and is rotatably supported on the bearing ring.

15 Claims, 6 Drawing Figures

BELLOWS MOUNTING ARRANGEMENT FOR SWIVEL CHAIR

FIELD OF THE INVENTION

This invention relates to an improved arrangement for mounting and supporting the upper end of a flexible cover, specifically a tubular bellows, used for enclosing the spindle of a vertically-adjustable swivel chair.

BACKGROUND OF THE INVENTION

Office chairs conventionally employ a seat assembly swivelly supported on a pedestal-type base. For this purpose, the seat assembly normally has a threaded spindle associated therewith, which spindle coacts with a nut arrangement associated with the base. This permits conventional swivelling of the seat assembly when the chair is occupied, and also permits the height of the seat assembly to be suitably adjusted in response to rotation of the seat assembly relative to the base. Such constructions, of many different types, are well known in the chair industry.

In view of the rather unsightly appearance created by the spindle and the related adjustment hardware, commonly referred to compositely as the spindle assembly, the chair industry has utilized various types of shrouds or closures for improving the esthetics of the chair, and providing for safety of operating personnel by restricting or limiting access to the spindle assembly. One cover which has been extensively utilized, although with less than satisfactory results, is an elongated boot (such as a bellows) constructed from an elastic rubberlike material, such as a plastics material. When such a boot or bellows is used for enclosing the spindle assembly, the lower end is normally anchored to the base so as to maintain the boot in a nonrotatable condition. However, due to the required rotation and swivelling movement of the seat assembly, the upper end of the boot is normally not supported on or connected to the seat assembly, but rather is normally solely urged into abutting engagement with the lower side of the seat assembly due to the springlike effect of the boot as created by its natural resiliency. While this arrangement does initially operate satisfactorily, nevertheless it has been discovered that when the boot is subjected to some standard usage conditions, the boot undergoes what is commonly referred to as inelastic creep. That is, the boot loses some of its elasticity or resiliency, and hence no longer sufficiently resiliently expands so as to urge the top end of the boot into its proper position when the chair seat is adjusted into or adjacent its uppermost limit. For example, when a chair seat is utilized adjacent its lowermost position for substantial periods of time, this continual compression of the boot causes inelastic creep, such that when the chair seat is again returned into or adjacent its uppermost adjusted position, the boot is unable to sufficiently elastically expand so that the upper end of the boot is thus spaced downwardly or sags relative to the chair seat. This obviously destroys the appearance of the chair. Because of this problem, many chair manufacturers have abandoned the use of boots and instead have adopted telescopic tube arrangements for enclosing the spindle assembly, although even these arrangements possess other features which are considered less desirable than boots.

Accordingly, it is an object of this invention to provide an improved arrangement for supporting the upper end of a boot relative to the chair seat, whereby the boot as used in surrounding relationship to the spindle assembly is positively extended whenever the chair seat is adjusted upwardly so as to insure that the boot effectively encloses the spindle assembly. This improved arrangement hence effectively overcomes the problems and disadvantages noted above.

In this invention, an extendible and contractible boot, such as a bellows, is constructed of a rubberlike material and is disposed in surrounding relationship to the spindle assembly. The lower collar or convolution of the boot is anchored to the pedestal associated with the chair base. The upper collar or convolution of the boot is mounted to and supported on the seat assembly by a retainer arrangement which prevents vertical separation between the boot and seat assembly but permits relative rotation therebetween. This retainer arrangement employs a bearing ring, preferably of a split construction, which is snugly and resiliently seated within the upper collar or convolution of the boot. A washer-like retainer plate is secured relative to the spindle and has an outer annular flange which is bearingly but rotatably supported on and by the bearing ring. The bearing ring has suitable locking tabs which overlap the upper edges of the annular flange for axially securing the bearing ring, and hence the boot, to the retainer plate. However, the retainer plate, and hence the chair seat, can rotate relative to the bearing ring.

Thus, one objective of this invention is the provision of an arrangement which axially secures the upper end of the boot to the seat assembly while simultaneously permitting relative rotation therebetween. Another objective is the provision of an arrangement, as aforesaid, which is structurally simple, economical to manufacture, simple to assemble, durable in operation, easily and simply disassembled and reassembled without requiring elaborate tools or skills, and does not affect or interfere with the desired esthetics of the chair.

Other objects and purposes of the invention will be apparent to persons familiar with this technology upon reading the following specification and inspecting the accompanying drawings.

Figure 1:
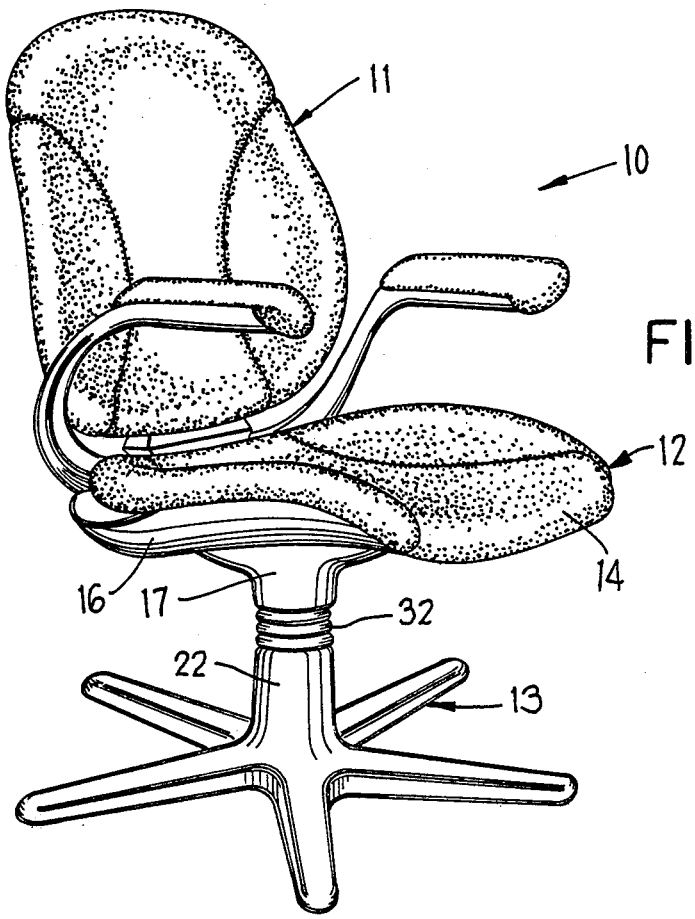
FIG. 1 is a perspective view of a swivel-type chair employing a boot between the chair seat and pedestal for enclosing the spindle assembly.

Certain terminology will be used in the following description for convenience in reference only, and will not be limiting. For example, the words "upwardly", "downwardly", "rightwardly" and "leftwardly" will refer to directions in the drawings to which reference is made. The words "upwardly" and "downwardly" will also refer to the direction of movement of the chair seat responsive to height adjustment thereof. The words "inwardly" and "outwardly" will refer to directions toward and away from, respectively, the geometric center of the chair and designated parts thereof. Said terminology will include the words specifically mentioned, derivatives thereof and words of similar import.

DETAILED DESCRIPTION

Figure 2:
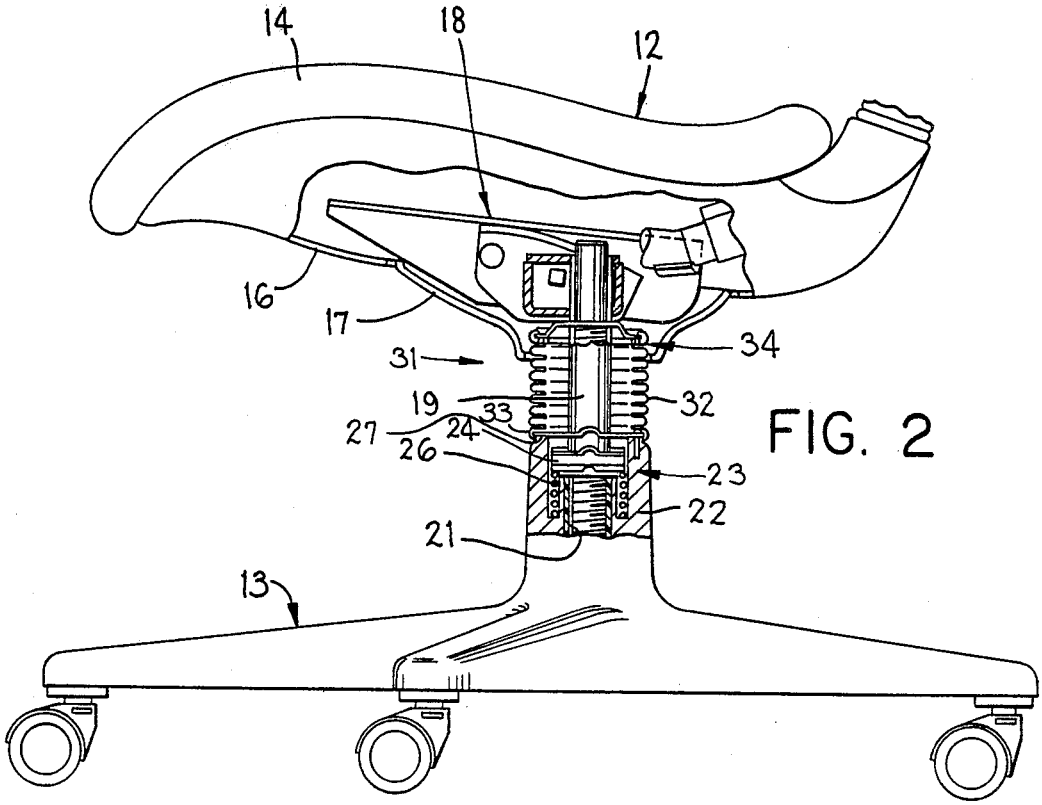
FIG. 2 is a fragmentary elevational view, partially in cross section, and showing the boot and spindle assembly used for joining the seat assembly and base.
Figure 4:
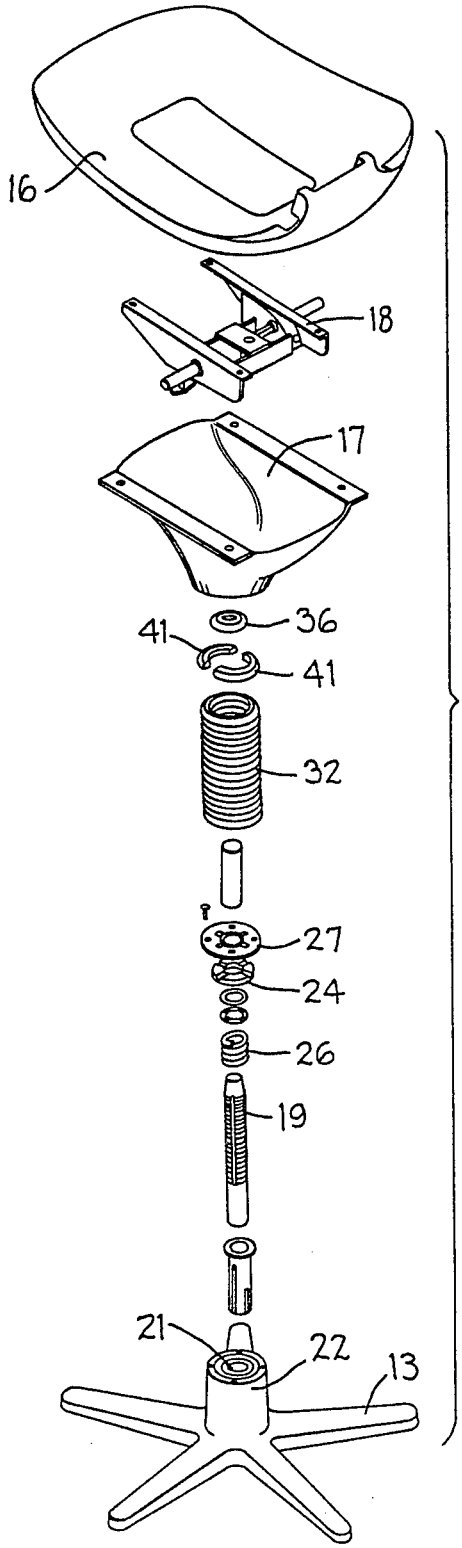
FIG. 4 is an isometric exploded view of the structure illustrated in FIG. 2.

FIG. 1 illustrates an office-type chair 10 having a back assembly 11, a seat assembly 12 and a pedestal-type base 13. The seat assembly 12, as illustrated by FIG. 2, includes a seat cushion 14 supported by an outer or lower shell 16, the latter having a funnel-like shroud 17 fixed thereto. A conventional chair control 18, examples of which are illustrated by U.S. Pat. Nos. 4,067,610 and 4,219,233, is disposed within the seat assembly.

The seat assembly 12 and base 13 are joined together by a spindle assembly which not only permits swivelling of the seat, but also enables the height of the seat to be adjusted upwardly or downwardly in response to rotation of the seat assembly relative to the base when the chair is unoccupied. Various spindle assemblies for accomplishing these purposes are already known. As illustrated, however, the spindle assembly includes a vertically-elongated spindle 19 which has its upper end fixed to the seat assembly, as by being staked to the frame of the chair control 18. The lower end of spindle 19 projects into an opening 21 which extends vertically through the center column or pedestal 22 associated with the base 13. A suitable height-adjusting mechanism 23 is provided for permitting the height of the seat assembly to be adjusted, and in the illustrated embodiment, this mechanism includes a nut 24 which is threadably engaged with the lower threaded portion of spindle 19. This nut 24, including the spindle 19 and seat assembly 14, are urged upwardly by a spring 26 such that, when the chair is unoccupied, the spring 26 causes the upper surface of nut 24 to be engaged with a clutch plate 27, the latter being fixedly secured to the upper end of pedestal 22. The engagement of nut 24 and clutch plate 27 prevents rotation of nut 24, and hence enables the seat assembly 12 to be vertically raised or lowered responsive to rotation thereof.

The spindle assembly, in the region between the seat assembly 12 and base 13, is enclosed by an extendible and contractible boot means 31. This latter means 31 includes an elongated boot 32 of tubular construction, which boot is formed from a rubberlike material, such as polyurethane or other suitable plastics materials. In the preferred embodiment, the boot 32 is formed as a bellows having multiple convolutions so that the bellows is capable of substantial axial extension or compression, and hence will accommodate and compensate for the height adjustment of the seat assembly.

The lower end of bellows 32 is suitably retained with respect to the base. For this purpose, the bottom convolution 33 of the bellows is axially and nonrotatably retained relative to the pedestal 22, this being accomplished in the illustrated embodiment by means of the lower convolution 33 accommodating therein the outer annular peripheral portion of the clutch plate 27, which plate is sized so as to project radially outwardly beyond the upper end of the pedestal.

Figure 3:
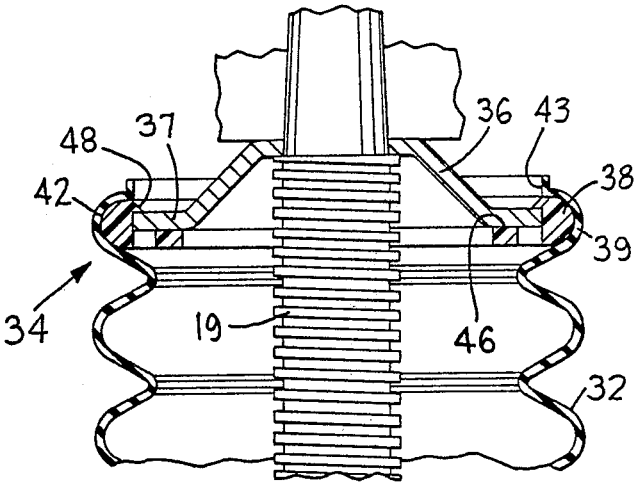
FIG. 3 is an enlarged, fragmentary sectional view illustrating the retainer arrangement located at the upper end of the bellows.

To insure that the upper end of bellows 32 will always follow the upward and downward height adjustment of the seat assembly, while at the same time permit the seat assembly to rotate relative to the bellows, the present invention provides a retainer means 34 for supporting the upper end of the bellows 32 on the seat assembly 14. This retainer means 34, as illustrated by FIGS. 2 and 3, includes a retainer member or plate 36 which is fixed relative to the chair control, as by being fixed to the upper end of the spindle 19 in the illustrated embodiment. This retainer plate 36 surrounds the spindle and projects outwardly therefrom, and terminates in an outer annular platelike flange or washer 37 which is of an outer diameter so as to be insertable into the upper end of bellows 32.

The retainer means 34 also includes a bearing ring 38 which is snugly and nonrotatably seated within the upper end of the bellows, such as by being snugly seated within the upper bellows convolution 39. The outer diameter of bearing ring 38 is preferably slightly greater than the inner relaxed diameter of convolution 39 so that the bearing ring 38 will cause at least slight elastic stretching of the convolution 39 to thereby snugly retain the bearing ring in its desired position.

The bearing ring 38 is preferably radially split so as to facilitate its insertion into the bellows, and its locking engagement with the retainer plate 36. As illustrated, the bearing ring 38 achieves this radially split relationship by being formed from two independent arcuate segments 41, which segments are identical and hence semicircular. These two segments 41 facilitate the insertion of the bearing ring through the reduced diameter opening 43 formed at the upper end of the bellows, while at the same time these two segments 41 can be seated in opposed relationship to one another within the upper convolution 39 so as to effectively function as an integral annular ring, particularly when the retainer plate 36 is axially locked thereto.

Figure 6:
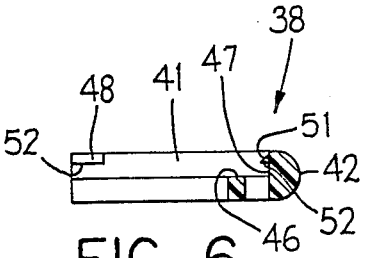
FIG. 6 is a sectional view taken along line VI—VI in FIG. 5.

As illustrated by FIG. 6, the outer peripheral surface 42 of the bearing ring 38, when viewed in axial cross section, is of a smoothly rounded configuration which closely approximates a semicircle so as to facilitate the insertion and seating of the bearing ring within the upper convolution 39.

To axially retain but rotatably support the retainer plate 36, the bearing ring 38 defines thereon an upwardly directed annular shoulder 46 which, at its radially outer edge, is bounded by an inner annular peripheral surface 47 projecting upwardly to the upper side of the bearing ring. This annular shoulder 46, and the surrounding peripheral surface 47, thus define an annular recess or seat for accommodating the outer annular flange 37 associated with the retainer plate 36. To axially lock or retain the retainer flange 37 within this latter recess, the bearing ring 38 has several locking or detent tabs 48 integrally formed thereon. These tabs individually extend through only a short circumferential extent, and several such tabs are uniformly spaced circumferentially around the bearing ring. In the illustrated embodiment, the ring 38 effectively has four such tabs 48 spaced at approximately 90° intervals.

Each locking tab 48 is disposed adjacent the upper side of the ring 38 and projects radially inwardly from the peripheral surface 47 so as to define on the underside thereof downwardly-directed shoulder 52 which is disposed directly opposite but spaced upwardly a selected axial distance from the annular shoulder 46. The axial spacing between these opposed shoulders 46 and 52 is such as to closely axially confine the retainer washer 37 therebetween, while at the same time permitting free rotation of the retainer washer relative to the bearing ring.

To facilitate axial insertion of the retainer washer 37 into the bearing ring 38, the tabs 48 are all provided with an upper cam surface 51 which slopes inwardly and downwardly. This cam surface is engaged by the outer lower edge of retainer washer 37 when the latter is axially moved downwardly into the bearing ring, thereby causing sufficient elastic deformation of the bearing ring and/or surrounding convolution 39 so as to enable the retainer washer 37 to snap into the recess defined between the opposed shoulder 46 and 52.

Figure 5:
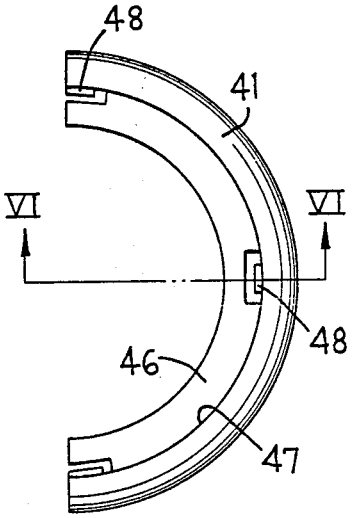
FIG. 5 is a plan view of one of the pieces forming the bearing ring.

As illustrated by FIGS. 5 and 6, each ring segment 41 preferably has a tab 48 provided thereon directly adjacent each free end thereof, and a further tab 48 is disposed adjacent the midpoint of the respective segment.

During usage of the chair, such as when the chair is occupied, then the weight of the occupant causes the seat assembly and the spindle to be urged downwardly against the urging of spring 26 so that nut 24 is disengaged from clutch plate 27, and hence is rotatably supported on the bushing located between the spindle and the pedestal. The chair seat can then freely swivel as desired, which swivelling causes the retainer plate 36 to freely rotate within the bearing ring 38 so that the bellows 32 remains nonrotatably fixed with respect to the base. At the same time, the upper convolution 39 of the bellows remains vertically fixed relative to the seat assembly.

When the chair is unoccupied, the spring 26 urges the seat assembly 12 upwardly a small distance so that nut 24 engages clutch plate 27, and hence the nut is nonrotatably connected to the base. Rotation of the unoccupied seat assembly 12 relative to base 13 then causes the spindle 19 to be threaded upwardly or downwardly through the nut, and hence effects respective raising or lowering of the seat assembly 12. During this rotational adjustment, the retainer plate 36 is again rotated within the bearing ring 38, which bearing ring 38 coupled with bellows 32 remains nonrotatably connected to base 13. However, as the height of seat assembly 14 is adjusted, such as being moved upwardly, the retainer plate 36 is also vertically displaced and hence causes a corresponding vertical displacement of the bearing ring 38, which in turn causes the desired axial extension (or compression) of bellows 32. Hence, the bellows always has the desired extension or contraction so as to totally surround and enclose the spindle assembly inasmuch as the extension or contraction of the bellows is positively controlled by the selected height of the seat assembly due to the vertical fixation between the seat assembly and the upper end of the bellows. Proper functioning of the bellows is no longer determined solely by the resiliency or elasticity of the bellows, and hence a more durable and reliable operation of the bellows is achieved.

To facilitate the construction of the bearing ring 38 and simultaneously provide for free rotation of retainer plate 36 relative thereto, the segments 41 of bearing ring 38 are preferably formed from a relatively hard but low friction material, such as a plastics or other synthetic material. One material particularly suitable for this purpose is a plastics material sold by Dupont under the trademark "Delrin".

As is believed apparent from the above discription, the mounting arrangement according to this invention, such as illustrated by FIGS. 2 and 3, involves only two basic parts (the retainer plate and the bearing ring) which can be manufactured simply and economically, and this arrangement can be assembled and disassembled efficiently and economically without requiring elaborate tools or skills. At the same time, the resulting arrangement is totally hidden within the bellows or shroud, and hence requires no major redesign or reconstruction of the remaining chair components.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a chair having a seat means, a pedestal-type base, a spindle assembly vertically joining the base and the seat means for permitting rotation of the latter about an upright axis defined by the spindle assembly, and an elongated extendible and contractible tubular boot disposed between said base and seat means in surrounding relationship to said spindle assembly, said boot having its lower end anchored to said base, the improvement comprising retainer means coacting between said seat means and the upper end of said boot for axially securing said upper end to said seat means while permitting relative rotation therebetween about said axis, said retainer means including a bearing ring snugly and nonrotatably seated within the upper end of said boot, and a retainer member fixed relative to said seat assembly and having an annular portion which is rotatably supported on said bearing ring, said bearing ring and said retainer member having means coacting therebetween for axially securing said bearing ring and said retainer member together.

2. A chair according to claim 1, wherein said bearing ring is radially split to facilitate its positioning within the upper end of said boot.

3. A chair according to claim 1, wherein said bearing ring defines therein an annular recess which opens axially upwardly, said bearing ring having an upwardly-facing shoulder defining the bottom boundary of said recess, said bearing ring further having plural circumferentially-spaced locking tabs which define thereon downwardly-facing shoulders which are disposed opposite but spaced upwardly from said upwardly-facing shoulder, the annular portion of said retainer member being axially but rotatably confined between the opposed shoulders.

4. A chair according to claim 3, wherein the bearing ring is radially split.

5. A chair according to claim 3 or claim 4, wherein said locking tabs are integral with said bearing ring and have tapered cam surface means thereon positioned for engagement by the annular portion of said retainer member when the latter is axially inserted into said recess for causing resilient expansion of said bearing ring so that said retainer member can snap into position between the opposed shoulders.

6. A chair according to claim 5, wherein said bearing ring is formed by at least two independent arcuate segments each having a said locking tab thereon, said segments being surrounded by the upper end of said boot and elastically urged inwardly by said boot so as to effectively form a continuous ring.

7. A chair according to any one of claims 1–6, wherein said bearing ring is constructed of a hard, low-friction plastics material.

8. A chair according to claim 1 or claim 2, wherein said boot comprises an elongated tubular bellows constructed of a rubberlike material and having multiple convolutions, said bearing ring being snugly and nonrotatably seated within the upper convolution of said bellows.

9. A chair according to claim 8, wherein the annular portion of said retainer member comprises an annular platelike washer which is rotatably supported on and by said bearing ring.

10. A chair according to claim 9, wherein the bearing ring has axially opposed upper and lower shoulders which are integral with said bearing ring and axially confine said washer therebetween.

11. A chair according to claim 10, wherein said bearing ring has cam means integrally associated therewith and disposed for reacting against the peripheral edge of said washer for causing elastic expansion of said bearing ring so that the washer can be axially inserted into and resiliently snapped between said opposed shoulders.

12. A chair according to claim 2, wherein said bearing ring is formed by two independent arcuate segments, said segments being surrounded by the upper end of said boot and elastically urged inwardly by said boot so as to effectively form a continuous ring.

13. A chair according to claim 12, wherein said boot comprises an elongated tubular bellows constructed of a rubberlike material and having multiple convolutions, said bearing ring being snugly and nonrotatably seated within the upper convolution of said bellows.

14. A chair according to claim 4, wherein said bearing ring is formed by two independent arcuate segments which are identical and each of which extends through an arcuate extent of approximately 180°, said segments being surrounded by the upper end of said boot and elastically urged inwardly by said boot so as to effectively form a continuous ring.

15. A chair according to claim 14, wherein said boot comprises an elongated tubular bellows constructed of a rubberlike material and having multiple convolutions, said bearing ring being snugly and nonrotatably seated within the upper convolution of said bellows.

* * * * *